United States Patent [19]

Driesmans

[11] 4,305,378

[45] Dec. 15, 1981

[54] SELF-REGULATING OPEN FIREPLACE

[75] Inventor: Jean Driesmans, Linden, Belgium

[73] Assignee: Warmluchtcentrale W.L.C. P.v.b.a., Belgium

[21] Appl. No.: 182,566

[22] Filed: Aug. 29, 1980

[30] Foreign Application Priority Data

Feb. 12, 1980 [BE] Belgium ..... 58400

[51] Int. Cl.[3] ..... F23L 3/00

[52] U.S. Cl. ..... 126/288; 126/120

[58] Field of Search ..... 126/120, 121, 131, 143, 126/288, 290

[56] References Cited

U.S. PATENT DOCUMENTS

| | | | |
|---|---|---|---|
| 787,808 | 4/1905 | Turver | 126/288 |
| 926,048 | 6/1909 | Champion | 126/288 |
| 1,067,203 | 7/1913 | Strasburg et al. | 126/288 |
| 1,080,777 | 12/1913 | Podmore | 126/288 |
| 2,854,967 | 10/1958 | Robinson | 126/288 |
| 4,233,956 | 11/1980 | Haynes | 126/288 |

*Primary Examiner*—James C. Yeung

*Attorney, Agent, or Firm*—William A. Drucker

[57] ABSTRACT

The invention concerns a self-regulating open fireplace and more particularly a corner open fireplace, a fireplace which is open on three sides and a fireplace which is open upon one side only.

In the fixed hood of the fireplace there is fitted a hinging movable hood of truncated cone shape of which, in one position, the bottom contour is in contact with the bottom contour of the fixed hood, and in a hinged position, a continuous passage is formed between the two hoods so as to create an air curtain in front of the open fireplace and to extract all excess smoke gasses, whereas means are provided between the movable hood and a flap valve mounted in the movable hood for adjusting the passage opening of the chimney, in view of the simultaneous control of the movable hood and of the flap valve.

7 Claims, 3 Drawing Figures

SELF-REGULATING OPEN FIREPLACE

The invention concerns a self-regulating open fireplace and more particularly a corner open fireplace, a fireplace which is open on three sides and a fireplace which is open upon one side only.

Known open fireplaces comprises a fixed hood which forms the upper part of the fireplace and the purpose of which is to evacuate the smoke gasses from the fireplace to the chimney, as well as a flap valve for regulating and shutting off the passage opening of aforesaid chimney. It is also known that an air passage is provided in the base of the open fireplace, for the induction of primary air.

Numerous solutions have already been suggested in order to save fuel and to obtain an economical combustion and heating process. The main problem encountered with open fireplaces is the too great consumption of excess air. This combustion air which is extracted from the living quarters assures a too rapid combustion of the fuel and an excessive air consumption. Consequently, the efficiency of the fuel consumed is insufficient and the flow of the gasses exhausted through the chimney is much too great, so that its $CO_2$ content is necessarily too low.

The purpose of the invention is therefore to solve this problem efficiently, and such equally for fireplaces which are open on three sides, corner fireplaces and fireplaces with but one open side.

In view hereof, the open fireplace according to the invention comprises a fixed hood, inside which is hinged a moving hood. The latter can be rotated in such a manner with respect to the fixed hood that a passage is created between the fixed and the moving hood, the cross-section of which can be varied. By means of some appropriate means or handle, the position of the moving hood with respect to the fixed hood can be adjusted, with a simultaneous adjustment of the position of the regulating and closing flap valve of the chimney. By these means, the size of the passage through which the smoke gasses reach the chimney is determined, whilst a balance is reached in the passage between the moving and the fixed hood and the passage towards the chimney, and such at least in the part where the open fireplace is indeed open (part of the circumference of the hoods). The balance is maintained by the fact that the two passages affect each other either in an opposing or in a stimulating manner, so that the flow of smoke gasses towards the chimney is determined as a function of the intensity of the fire. This passage sees to it that a regular air curtain is created, and such on all sides where the fireplace is open. This air curtain moreover sees to it that the smoke gasses cannot escape towards the living room or living quarters, and encloses as it were the open fireplace. The air curtain replaces the mass of ballast air used in the usual open fireplaces as protection against returning smoke. This air curtain also sees to it that the chimney is maintained at the correct degree of vacuum and that the correct flow of smoke gasses is obtained. Hence the necessity of limiting the combustion air by means of the throughlet opening provided in the base of the fireplace, in order to adjust the correct flow of air under the fire.

A detail of the invention consists in the fact that the handle, by means of which the location of the moving hood with respect to the fixed hood is adjusted, consists of an arm which swivels in a vertical plane and simultaneously adjusts the position of the chimney closing flap valve and that of the moving hood, and consequently also adjusts the passage of the smoke gasses. The position is adjusted in accordance with the drought of the chimney.

Further details and particulars will appear from the following description of a self-regulating open fireplace according to the invention. The description is given merely as an example and refers to the appended drawings, in which.

Figure 1:
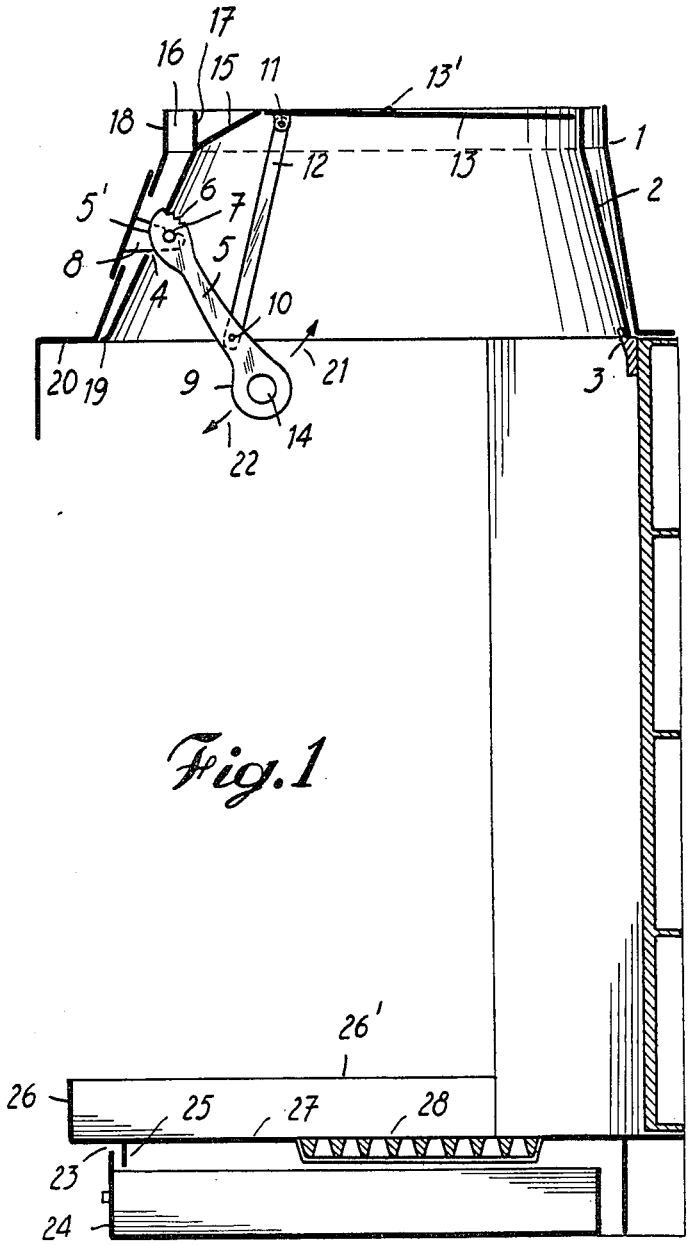
FIG. 1 shows a schematic vertical section of an open fireplace with closed chimney valve, according to the invention.
Figure 2:
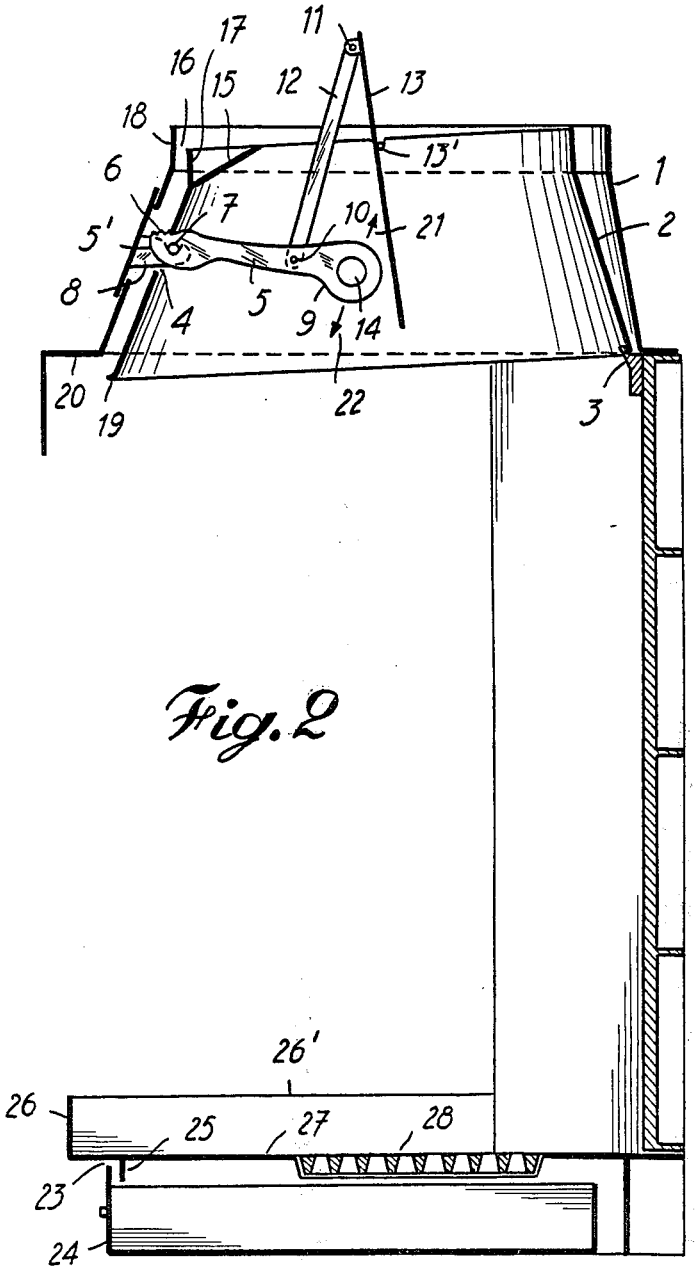
FIG. 2 shows a schematic vertical section of an open fireplace with opened chimney valve, according to the invention.
Figure 3:
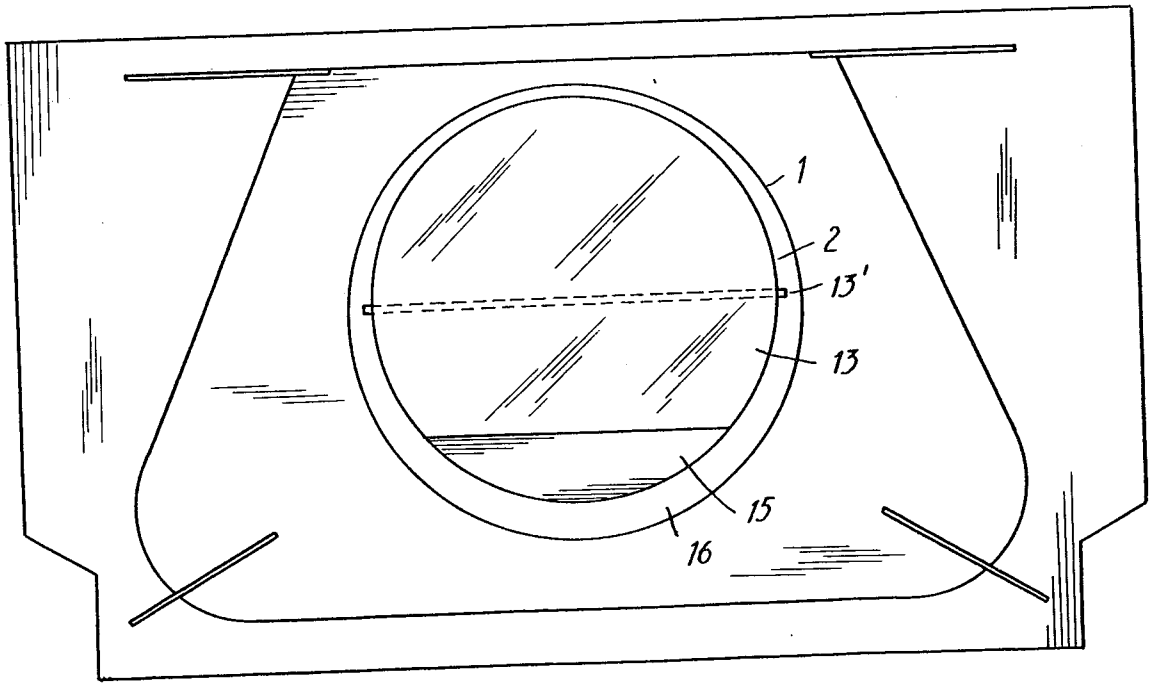
FIG. 3 is a top view of an open fireplace according to the invention.

The open fireplace according to the invention mainly consists of a fixed hood 1 which, in vertical section, displays the general shape of a truncated cone. Hood 1 forms the part which connects at its lower end to the remaining elements of the open fireplace, and which leads at the top into the evacuation duct of the chimney. Inside this hood 1 there is fitted a hinging moving hood 2 which rests at the rear (to the right in FIGS. 1 and 2) upon a support 3 and is provided at the front with a slot 4 through which protrudes the end 5' of an arm 5. This end 5' is provided with a series of teeth 6 in view of the adjustment of the moving hood which, in the course of its movement pivots around support 3. The end 5' of arm 5 hinges around a shaft 7 which rests in notches of two platelets 8, which are attached on the inside of the fixed hood. Arm 5 comprises an extension 9 with a pivot pin 10, around which a rod 12 is pivotally attached. The other end of rod 12 is pivotally attached to a flap valve 13, which is pivotally suspended by means of two trunnions 13' which fit in two bearings which are an integral part of the moving hood 2. Extension 9 of arm 5 is provided with an eyehole 14 into which a hook or any other appropriate means can be inserted in order to adjust the lifting mechanism which consists of arm 5 with extension 9, of pivot shafts 7, 10 and 11 and of rod 12, the purpose of which is the simultaneous control of flap valve 13 and of the moving hood 2. In order to obtain at the front side (to the left in FIGS. 1 and 2) an optimum passage 16 between the fixed hood 1 and the moving hood 2, the latter is provided with an upturned edge 17 which, in the closing position of the hood, runs almost parallel with the upturned edge 18 of the fixed hood 1 (FIG. 2). In the closing position the bent over edge 19 of the moving hood 2 fits closely against the lower edge 20 of the fixed hood 1. By moving the eyehole 14 in the direction of arrow 21 (FIG. 1), the toothed end 5' of the arm 5 is rotated in the slot 4 of the moving hood 2. Consequently the top edge of slot 4 of moving hood 2 will rest upon the lowest tooth 6 of arm 5, so that the opening between the bent over edge 19 of moving hood 2 and the lower edge 20 of the fixed hood increases, whereas the flap valve 13 will take up a vertical, or almost vertical position. The closing of flap 13 and the narrowing of the passage between edge 19 of the moving hood 2 and lower edge 20 of fixed hood 1 will occur in the opposite direction, according to arrow 22 (FIG. 1). The adjustment of the air inlet 23 of the fireplace (FIG. 1) is performed by moving the drawer 24 with respect to the fixed wall 25, so that a specific opening is obtained. The raised wall or walls 26 and 26' are provided on all open sides of the open fireplace. This prevents that too much air should be sucked up across base plate 27 towards the fire. The air which is admitted through parts 23–24–25 is spread out under the fire along an appropriate grid 28. A balance is thus obtained between the supply flow of primary air and the flow through the passages in the hood.

From the description given above it consequently appears that the open fireplace according to the invention operates with static self-regulation. It will be seen indeed that the smoke gasses, besides being evacuated through the normal exhaust opening to the chimney, are also evacuated via the passage between the fixed hood 1 and the moving hood 2. The restriction in the evacuation opening increases the velocity of the gasses in the circular passage between aforesaid hoods. A vacuum is consequently created due to which air is extracted via the passage from the living quarters, and due to this same vacuum, the smoke gasses are sucked up out of the fireplace via aforesaid opening, so as again to stimulate the restricted chimney. Due to the shape of the passage between the fixed hood 1 and the moving hood 2, the vacuum is uniformly distributed over the entire length of the passage. As a consequence hereof, both the restriction and the stimulation mentioned above are uniformly distributed along this passage. The enclosing air curtain which is hereby created is, contrary to anything known up till now, much more regular and homogeneous. As a result hereof, an optimum efficiency is obtained from the fuel used, without danger of the open fireplace smoking. As a function of the construction and of the relative position of the components with respect to each other, the possibility exists of maintaining the flow of gasses through the evacuation opening and through the circular passage within certain limits. When the open fireplace is not in operation, a perfect closure must be provided, so that practically no air is exhausted from the living quarters. As it appears from the description above, the moving hood 2 hinges at the rear side with respect to the fixed components of the fireplace, and amongst others with respect to the fixed hood 1, so that an extra passage for the burnt gasses can be created on three sides, and such according to whether the open fireplace is open along one, two or three sides, but never however along the rear side of the fireplace. The expression "along three sides" must be understood as meaning a circular arc of approximately 270°. The required air is therefore exhausted from the living quarters along a certain length of the moving and of the fixed hoods, which corresponds approximately to the aforementioned 270°. The air exhausted from the living quarters acts upon the chimney regulation and is prevented from taking part in the combustion, considering that this air is evacuated directly to the chimney via aforementioned passage. As a consequence hereof, the open fireplaces which are equipped with a self-regulating system and with an air inlet grid which is in balance in the base of the open fireplace, according to the invention, have an average air consumption of about one quarter of that of the usual fireplaces, whereas the fuel consumption is on the average reduced to below 50%. The cross-section of the chimney may, in such cases, be reduced by an average of some 20% with respect to what is normally provided. The combustion process is, as stated and emphasized above, submitted to a better regulation by alternately admitting and restricting the primary air. This neutralizes the effect of the chimney vacuum upon the fire, so that the latter can be regulated by admitting more or less primary air to the combustion.

It is perfectly obvious that the invention is by no means limited to the form of embodiment described above, and that many alterations can be brought about without going beyond the scope of the invention.

I claim:

1. Self-regulating open fireplace comprising a fixed hood in truncated cone shape forming the upper part of the fireplace, for evacuating the smoke gasses from the fireplace to the chimney, a hinging movable hood of truncated cone shape mounted within said fixed hood and touching in rest position the bottom contour of the fixed hood and in a hinged position forming a continuous passage between the two hoods to form an air curtain in front of the open fireplace and to extract excessive smoke gasses, said movable hood further including an internal passage opening for passing of smoke gases, a flap valve mounted pivotable in said movable hood, for regulating and closing the passage opening in said movable hood, and means provided between said movable hood and said flap valve, for the simultaneous control of said movable hood and said flap valve.

2. Self-regulating open fireplace as defined in claim 1, in which said passage between the fixed hood and the movable hood widens in the direction of the chimney, at least over part of its contour.

3. Self-regulating open fireplace as defined in claim 1, in which said means for the simultaneous moving of the mobile hood within the fixed hood and of the flap valve consist of a linkage.

4. Self-regulating open fireplace as defined in claim 3, in which said linkage consists of a pivotable arm in a vertical plane, of which one end pivots around a shaft which is part of the fixed hood, this end being provided with teeth and protruding through an opening of the movable hood, the latter resting upon said teeth, the other end of said arm being pivotally connected to the flap valve by means of a rod.

5. Self-regulating open fireplace as defined in claim 1, in which said flap valve is pivotally suspended around a shaft which extends straight trough the opening of the movable hood.

6. Self-regulating open fireplace as defined in claim 1, in which said movable hood has an inwardly directed edge against which fits the flap valve when in closed position.

7. Self-regulating open fireplace as defined in claim 1, in which means are provided in the base of the open fireplace for adjusting the supply of primary air and the combustion capacity.

* * * * *